United States Patent [19]

Binder

[11] Patent Number: 4,585,923

[45] Date of Patent: Apr. 29, 1986

[54] HEATING CABINET

[76] Inventor: Peter M. Binder, Schaffhauser Str. 19, 7200 Tuttlingen, Fed. Rep. of Germany

[21] Appl. No.: 532,997

[22] Filed: Sep. 16, 1983

[30] Foreign Application Priority Data

Sep. 23, 1982 [DE] Fed. Rep. of Germany ..... 3235130

[51] Int. Cl.[4] ..... F24C 7/06

[52] U.S. Cl. ..... 219/400; 219/407; 126/21 A

[58] Field of Search ..... 219/400, 406, 407, 390; 126/21 R, 21 A; 34/195, 196, 197, 198

[56] References Cited

U.S. PATENT DOCUMENTS

| | | | |
|---|---|---|---|
| 787,584 | 4/1905 | Matteson | 219/406 |
| 1,127,021 | 2/1915 | Klett | 219/407 |
| 2,505,117 | 4/1950 | Hoffmann | 219/407 |
| 3,651,240 | 3/1972 | Kirkpatrick | 219/406 |
| 4,327,279 | 4/1982 | Guibert | 219/400 |
| 4,381,442 | 4/1983 | Guibert | 219/400 |

FOREIGN PATENT DOCUMENTS

| | | | |
|---|---|---|---|
| 1362218 | 4/1964 | France | 219/406 |
| 378468 | 7/1964 | Switzerland | 219/400 |

OTHER PUBLICATIONS

Brochure of Blanc and Fischer, "Rohrheizkörper für Heissluftbacköfen".

Brochure of Hoffman, "Technisch-Physikalische . . . ".

*Primary Examiner*—C. L. Albritton

*Assistant Examiner*—Teresa J. Walberg

*Attorney, Agent, or Firm*—Oliver D. Olson

[57] ABSTRACT

A heating cabinet is formed of inner and outer side and bottom walls defining an antechamber between them which communicates only at the bottom wall portion with a rear air passage chamber formed between the inner and outer rear walls. A one-piece U-shaped heater of meander-like shape is contained in the antechamber spaced from the walls thereof.

10 Claims, 7 Drawing Figures

1
2
3
4
5
6
7
8
9
10
11
12
13
15
38
a
b
h
l
R
r

HEATING CABINET

BACKGROUND OF THE INVENTION

This invention relates to heating chambers such as hot air sterilizers, ovens and the like, and more particularly to a heating cabinet which utilizes an antechamber construction that requires only a single heating element to provide adequate, uniform heating of the interior portions of the cabinet. Such heating cabinets have been used for the most varied purposes for a long time. It has been considered necessary to construct the heater in multipart manner due to the advantageous parallelepipedic construction. Separate heaters have at least been provided for the vertically superimposed side parts and the base part, whereby each of said heaters has had to be provided with two connections for securing and conducting electric power or a hot heat transfer agent. It is therefore necessary to provide for the two side parts and the base three heaters with a total of six connections. This naturally had led to considerable expenditure, not only for the production of the three different heaters with their connection, but also in connection with the fitting and assembly. Thus, the six connections must obviously also be fitted.

Apart from the aforementioned meander-like heating rods, straight heating rods have also been used, which are externally fixed to the boiler and indirectly heat the same. However, in general, much larger numbers thereof must be used, so that the aforementioned disadvantage is exacerbated compared with the meander-like construction, which has the advantage of being able to heat a larger area. However, these heaters lead to control problems linked with their large mass, which leads to a high time constant. In addition, boilers made from relatively poor heat conducting material cannot be heated, because the high heating density given off by the heater over the contact surface between the latter and the boiler cannot be transferred away without considerable warping of the boiler material.

In addition, in the case of special constructions, such rod-like heaters are also arranged in exposed manner in the heating chamber, which also causes a cleaning problem for the boiler.

In addition, finned radiant heating also exists in which the inner walls of the boiler have fin-like portions, in which are fitted heating conductors insulated by ceramic beads. Quite apart from extremely time-consuming fitting and difficulties connected with their repair, the spatial temperature uniformity is unsatisfactory, particularly when the fins approach the boiler walls. As in the case of the previously described process, the heaters are in contact with the boiler walls, so that they have a much higher temperature than the air in the boiler.

Moreover, integral fin tube heaters are known and are used for equipping space heaters, warming cabinets, domestic baking ovens, heating compartments and the like. They also have beadinsulated heating coils, held by an integral fin tube, which is open at one side. Here again, at least two heaters are required, even in the case of relatively flat boilers, such as e.g. domestic ovens. In the case of higher boilers or applications requiring good temperature uniformity, the side walls must be additionally heated by means of elongated fin tube heaters (Brochure of Blanc and Fischer, 7135 Oberderdingen).

Circulating air cabinets are also known, which have an antechamber extending over only part of the rear wall of the work space. The fresh air is sucked in from behind and is directed against the rear wall by means of a radial fan through the aforementioned relatively small antechamber. As soon as the air has left the antechamber, it is forced towards the sides on the cold inner walls and up to the front wall and is then sucked rearwards again in the centre of the work space. There is consequently a constant cooling of the air on its path from the heater back to the air duct. This more particularly applies with respect to the air masses flowing past the cold, unheated side walls of the boiler and its bottom, so that there is a temperature gradient within the cabinet (Brochure of Messrs A. Hoffman, 7302 Nellingen).

SUMMARY OF THE INVENTION

The problem of the invention is to so improve the heating cabinet of the aforementioned type that it can be manufactured with limited expenditure, ensures a good spatial temperature uniformity and provides favourable conditions for the use of thermostats.

According to the invention, this problem is solved by the provision of a cabinet and heater construction which lead not only to the advantage that there are far fewer individual components, but also assembly and fitting are considerably facilitated.

The characterizing features of providing a construction which utilizes a heat element-containing antechamber that communicates heated air to an interior, working chamber serve to further develop the invention. As a result of this antechamber, a much greater spatial homogeneity of the heating is obtained than would be possible with heaters directly fitted to the boiler or located directly in the boiler. This is because the heaters which are necessarily well above the boiler temperature are not in contact with the inner walls of the boiler and instead bring about a good spatial homogeneous heating of the antechamber air. The preferably good thermally conducting inner boiler further reduces existing spatial temperature differences, so that all the heated surfaces of the inner boiler very accurately have the same temperature. The chamber is uniformly heated from the outside to the inside and from the bottom to the top, because as is known, heat rises. This is also the reason for the U-shaped construction of the heater. It is also possible to make use of the aforementioned possibility of a box-shaped or O-shaped construction of the heater, so that it surrounds the antechamber on all sides. The structural features of the heating cabinet of this invention are very useful for further developing this uniform heating. For example, it is appropriate for the power density of the sidewalls to be lower than that of the base. According to the invention, this can be satisfactorily controlled by the shape of the heater only. In addition, surprisingly good control results are obtained with limited expenditure if, in place of the boiler temperature, the temperature in the antechamber is used as an auxiliary output quantity.

The invention also provides a process for producing the aforementioned heater, which leads to a simple spatial bending of the heater.

The heating cabinet of this invention can also be used as a circulating air cabinet. This leads to the important advantage that the circulating air is completely uniformly heated on the side walls and the base and is only then forced through the holes in the inner boiler, so that a very good temperature unifomity is obtained.

BRIEF DESCRIPTION OF THE DRAWINGS

The invention is described in greater detail hereinafter relative to non-limitative embodiments and the attached drawings, wherein show.

DETAILED DESCRIPTION OF THE INVENTION

Figures 1, 2:
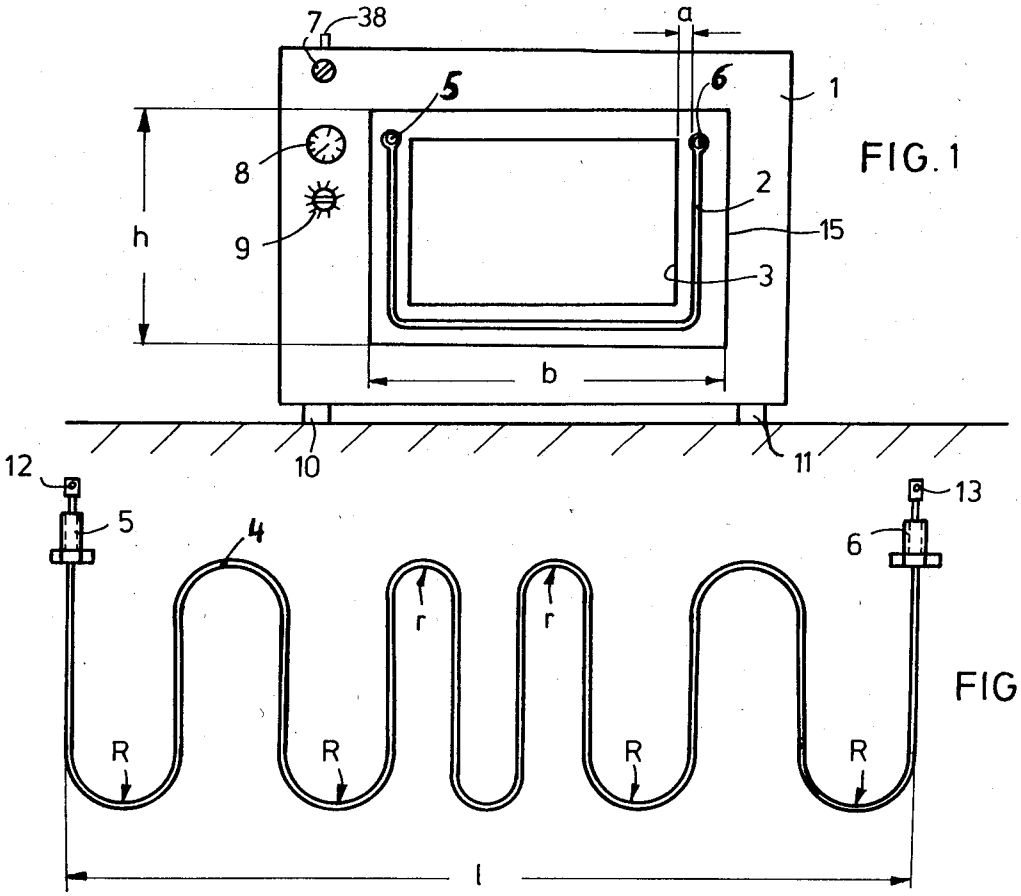
FIG. 1 a diagrammatic front view of a heating air cabinet according to the invention, the door and front frame being omitted.
FIG. 2 a plan view of a heater according to the invention after the first production stage and on a larger scale compared with FIG. 1.

FIG. 1 shows a hot air cabinet 1, whose opening is visible, because the door and front frame have been omitted.

On the left-hand side of the well insulated steel outer casing, it is possible to see from top to bottom, a certain number of control switching elements. At the top, there is a control button 7 for the air damper for controlling air intake and discharge. Below it, there is a control thermometer 8 and a further switching element 9. Below these, can be provided further switching and control elements. However, this is of no importance for the invention and is consequently not shown.

FIG. 1 also shows the height h and width b of outer boiler 15. Within it and between it and the inner boiler 3, there is heater 2 which, according to the invention, is bent in U-shaped manner, so that it follows onto these two side parts and the base of the heating space with a relatively limited spacing, but is not in contact therewith. At both ends of heater 2, the two connections 5, 6 thereof are screwed into the rear wall of the heater, as will be explained hereinafter. There are no further connections between cabinet 1 and heater 2, so that with the exception of these two connections, there can be no heat bridge.

At a limited distance a is arranged the inner boiler 3, which is e.g. made from stainless sheet steel and is also connected in easily dismantlable manner with the rear wall. As a result of antechamber 14, which is preferably closed on all sides with the exception of the front opening, a greater homogeneity of the heat transfer from heater 2 to the inner area of inner boiler 3 is achieved, which means that local overheating of parts closer to the side walls than others is avoided. Thus, the heating area within the boiler is uniformly heated.

The indicated distance a between heater 2 and inner boiler 3 can be small, i.e. e.g. only 2 to 4 mm, so that the space is well utilized and an approximately equally thick air space surrounds the heater 2 on all sides. At the bottom, the cabinet rests on rubber feet 10, 11.

FIG. 2 shows heater 4 after the first production stage. In this case, the heater is constructed in conventional manner with a planar surface and is bent in meander-like manner, i.e. is only bent in one plane. According to the invention, length 1 is somewhat smaller than the total of the two heights h of the sides of the inner area of heating cabinet 1 according to FIG. 1, plus the width b of the base surface.

Thus, it is a tubular electrical heater 4, which is provided with connections 5, 6 at both ends. These are threaded nipples, which are fixed to the tubular heater 4, i.e. are moulded or welded therewith. At the ends are provided plug-like connections 12, 13, which are insulated from the heater, but need not be shown in detail, because such connections form part of the prior art. This also applies regarding the meander-like ends between connections 5, 6. However, the radii R of the two outer bends are larger than the radii r of the two inner bends.

For the complete manufacture of the object of the invention, the two outer parts with radii R are bent upwards out of the represented plane in FIG. 2, so that the U-shape of heater 2 of FIG. 1 is obtained. This is the second and last production stage. Therefore, the middle part with the smaller radii r comes to rest on the base part, whilst the outer parts with the larger radii R form the sides of the U.

The O or box-shape can be bent in a similar way and additionally in the uppermost area in FIG. 1 is positioned part of the heater with the bends.

The heater can easily be fitted in this form, in that the two connections, 5, 6 are passed through the holes in the rear wall of the heating cabinet according to FIG. 1 and are subsequently screwed in with nuts, following which the electrical connections 12, 13 are fitted.

Surprisingly, this mechanical fixing with the two connections 5, 6 is sufficient for keeping the spatially bent heater 2 in its position according to FIG. 1 at a distance from all the parts of the cabinet. In addition, replacement is very simple, through merely loosening the nuts and drawing the complete heater 2 frontwards through the outer boiler.

In a similar way, inner boiler 3 can be very easily fixed to the rear wall of the cabinet. However, it can also be loosely inserted in upper rails.

As a result of the different radii R and r, a differing power density is obtained. A greater power density is required on the bottom than on the two sides, e.g. the power density can be adjusted in such a way that the two sides of the U-shaped construction together have roughly the same power as the base.

Although only one embodiment is shown, it is obvious to the Expert that a large number of further embodiments are possible within the scope of the claims. For example, heater 2 need not be an electrical heater and could be a heater through which flows hot oil. However, preference is given to electrical heaters in the case of hot air sterilizers, such as general purpose cabinets.

Moreover, and as stated hereinbefore, heater 2 need not be U-shaped and can instead be O or box-shaped, if special temperature stratifications are to be produced in the boiler.

The invention leads to a simplification of the manufacture of the heating cabinet, because it simplifies the manufacture of the previously at least three-part heater. In addition, the heater, particularly in conjunction with antechamber 4 according to claim 2 provides a very good temperature uniformity and optimum conditions for the use of thermostats.

Figure 3:
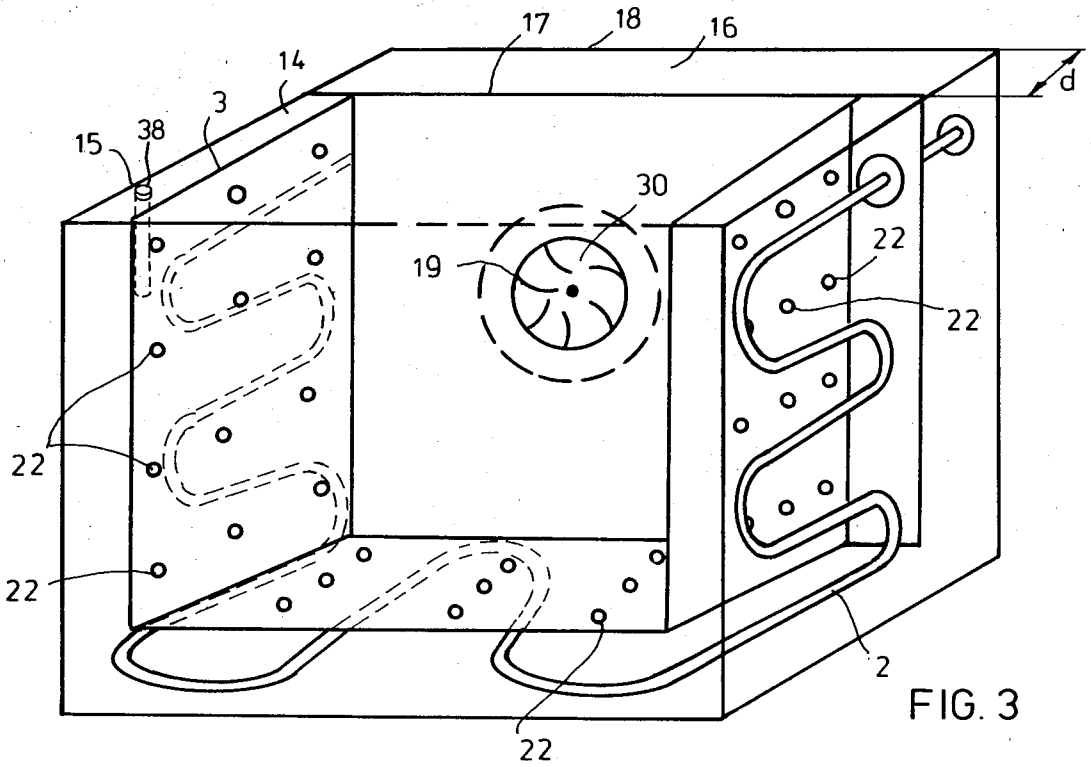
FIG. 3 a perspective view of a further embodiment.

FIG. 3 shows an embodiment with a circulating air cabinet, for which purpose a chamber 16 is formed in the rear part of the heating cabinet in such a way that there is a separate front wall 17 parallel and with a spacing d with respect to rear wall 18. Thus, to a certain extent an additional antechamber is formed in the rear area. In the centre thereof, an opening 19 is provided in wall 17, through which it is possible to see a radial fan impeller 30. There is an open connection in the bottom area between chamber 16 and antechamber 14, which are of the previously described construction. In addition, there are numerous holes 22 throughout the inner boiler 3.

Figure 4:
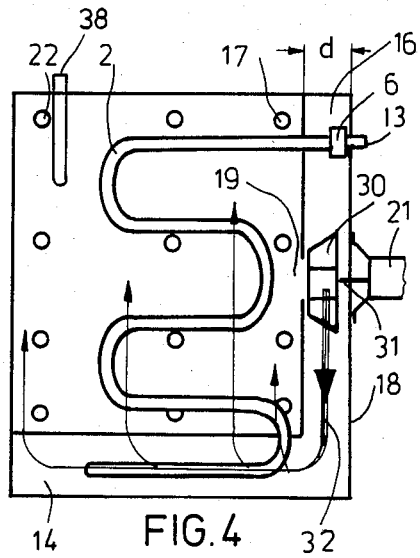
FIG. 4 a diagrammatic side view of the embodiment of FIG. 3.

FIG. 4 is a side view of the embodiment according to FIG. 3. It can be seen that the drive unit 21 for impeller 30 is provided on rear wall 18 so that shaft 31 thereof passes through this wall.

An arrow 32 and numerous further arrows are provided to show part of the air flow. This is directed downwards, where it is pressed through the aforementioned open connection into antechamber 14, from where it passes through the numerous openings 22 into inner boiler 3.

Figure 5:
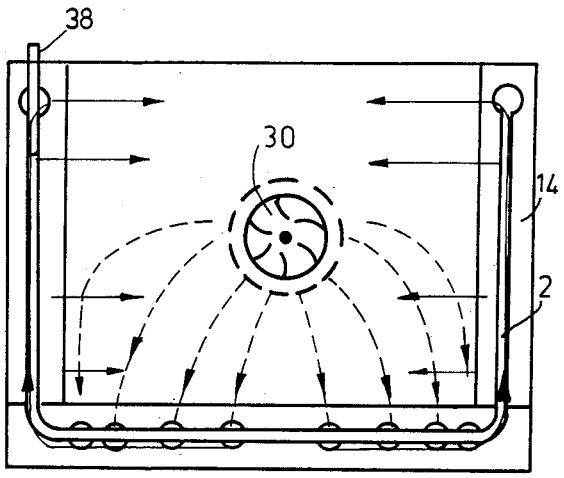
FIG. 5 a diagrammatic front view of the embodiments according to FIGS. 3 and 4.

FIG. 5 is a diagrammatic front view of the same embodiment, showing that heater 2 and antechamber 14 are the same as in FIG. 1. A large number of arrows show the circulating air flow, which passes from both sides through holes 22 into the interior of inner boiler 3.

Figure 6:
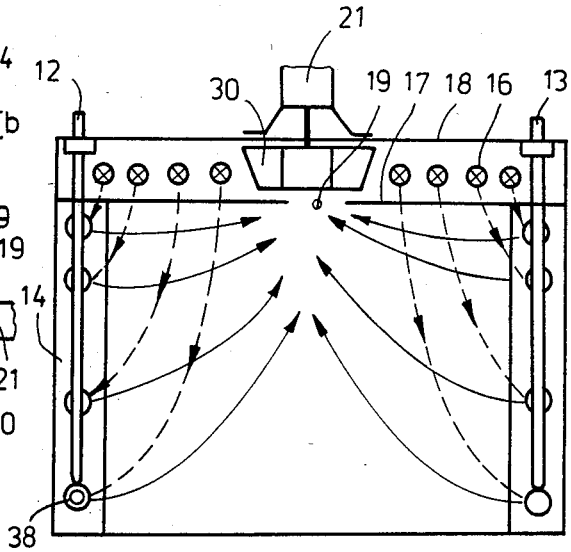
FIG. 6 a plan view of the embodiments according to FIGS. 3 to 5.

FIG. 6 shows the same view from above, where it is once again possible to see the flow in the bottom of the antechamber and in the inner area as a result of the large number of arrows. It is clear that the circulating air flows from the two side walls to opening 19. The air is then sucked by impeller 30 through opening 19 and is directed radially upwards and downwards to all sides through chamber 16 into antechamber 14. This provides the important advantage that the air is initially uniformly heated in the antechamber and then passes from all sides into the interior of the working space.

There is also a thermometer probe 38 and/or sensor in antechamber 14 in the vicinity of outlets 22, which constitutes the optimum location for the same.

The invention leads to an antechamber heating. The air is sucked through the circular opening 19, sped up by the impeller and then radially moved away. By means of not shown air deflectors, as a function of the operating mode, all the air is forced into the base area of the antechamber or, in the case of fresh air addition, passes partially into the open as used air, controlled by an air damper.

In the case of a purely circulating air operation, the air flows through the bottom part of the heater, is heated and is subdivided into two air flows, which then rise in the sides of the antechamber. The air is then again heated by the lateral parts of the U-shaped heater, before it passes into the working space through the holes 22 in the inner boiler. It is ensured that the air discharge speeds from the holes are approximately the same through further air deflectors and a corresponding choice of the size, position and number of the holes.

This leads to a good spatial temperature precision in the inner area, because in addition to the warm air flow, the two sides and the bottom are also heated, whilst the warm air flow is not chilled. The air is guided over the heaters until just before it enters the working space and is consequently heated. Thus, as a result of the invention, there is a good thermal homogeneity even in very deep working spaces. In addition, the temperatures in the working space are independent of the air velocity. There is also the further advantage that if the fan motor fails, the heating cabinet continues to operate as a conventional non-circulating air-operated heating cabinet. There is no change to the set temperature in the working space.

As a result of their considerable length, the heaters can have a low power density. Thus, local overheating is prevented and there is no safety hazard.

Figure 7:
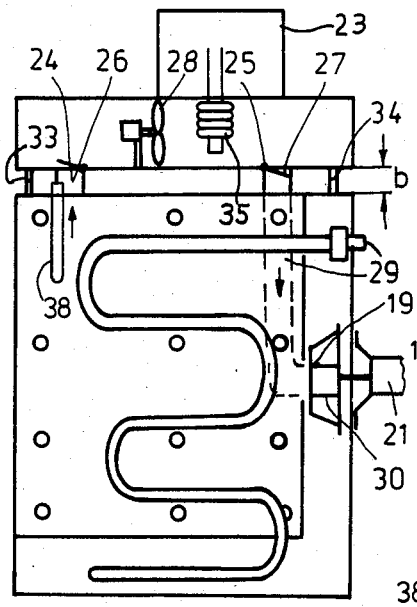
FIG. 7 a diagrammatic side view of a further embodiment.

FIG. 7 shows another embodiment, in which a cooling chamber 36 rests on feet 33, 34 with a spacing b. The Expert is well aware of the details of refrigerators and there is no need to represent these.

The used air flows upwards into cooling chamber 36 through the left-hand duct 24 and can be regulated by regulating member 26. The driven fan 28 does not form part of refrigerator 23 and is instead provided additional thereto for controlling the transfer of the circulating air for the inner boiler. The cooled air passes through duct 25 downwards and in this case is passed by a line 29 directly to opening 19 of impeller 30. A regulating member 27 can also be provided in this duct.

This embodiment has the advantage that cabinet temperatures can be reached, which are well above the maximum permitted temperatures of refrigerating systems. In practice, unlimited high temperatures can be reached. The embodiment also permits very low temperatures, e.g. down to minus 80° C.

There are numerous possible uses for the object of the invention and in particular electronic components can be tested and manufactured. As stated, it is also possible to simulate the most varied temperatures in order to test specific materials or objects. However, it is also possible to harden plastics, e.g. prostheses. There are also numerous uses in the pharmaceutical industry. These cabinets are also used as cooling incubators, as microbiological cabinets and as air conditioning testing cabinets.

The embodiment according to FIG. 7 can be modified in the following way. Refrigerator 23 and evaporator 35 are completely eliminated and instead, via line 29, gas and/or cold air is led to the centre of opening 19. The cross-section of line 29 can be much smaller than opening 19 for impeller 30. This also leads to an admixing of a gas or cold air with the sucked in warm air.

The invention is not restricted to the represented embodiments and the Expert can make a random number of modifications thereto within the scope of the claims.

What is claimed is:

1. A heating cabinet comprising:

(a) an inner chamber having inner side walls, a bottom wall, a rear wall, and a top wall, (b) outer side and bottom walls spaced apart from said side and bottom inner chamber walls and defining a U-shaped antechamber therebetween, (c) an outer rear wall spaced apart from said rear inner wall and defining a rear air passage chamber therebetween, said rear chamber communicating with the antechamber only between the inner and outer bottom walls, and (d) a one-piece, U-shaped heater of meander-like shape contained within the U-shaped antechamber in spaced apart relation to said inner and outer walls.

2. The heating cabinet of claim 1 including a plurality of holes through only said inner side and bottom walls for communicating said heater-containing antechamber with said inner chamber.

3. The heating cabinet of claim 2 wherein said rear inner wall is provided with an opening, behind which is disposed a fan associated with a fan motor mounted on said rear outer wall, the fan drawing air from the inner chamber into said rear chamber and thence into said antechamber from the bottom to the sides thereof for heating by the heater, whereupon the heated air is communicated back into the inner chamber through said holes in the inner side and bottom walls.

4. The heating cabinet of claim 3 including a source of coolant fluid outside the cabinet, duct means for communicating the source of coolant fluid with the opening in the rear inner wall in front of the fan, and control means associated with the duct means for controlling the delivery of coolant fluid to said opening.

5. The heating cabinet of claim 2 including a temperature probe in the antechamber adjacent one of the holes in the inner wall.

6. The heating cabinet of claim 1 wherein said meander-like shaped heater is configured with arcuate bends having radii arranged to provided a higher power density along said bottom wall than the power density along each side wall.

7. The heating cabinet of claim 6 wherein the heater in the antechamber adjacent the side walls is configured to provide an approximately equal power density in the combined side walls as is provided by the heater in the antechamber adjacent the bottom walls.

8. The heating cabinet of claim 6 wherein the meander-like shaped heater is configured with arcuate bends having larger radii disposed in the antechamber adjacent the side walls and smaller radii disposed in the antechamber adjacent the bottom walls.

9. The heating cabinet of claim 1 including a source of coolant fluid outside the cabinet, duct means for communicating the source of coolant with the antechamber, and control means associated with the duct means for controlling the delivery of coolant fluid to the antechamber.

10. The heating cabinet of claim 9 wherein the source of coolant fluid includes a coolant chamber outside the cabinet, an inlet duct communicating the coolant chamber with the antechamber, a return duct communicating the inner chamber with the coolant chamber a spaced distance from the inlet duct, refrigeration means in the coolant chamber for cooling air returned from the inner chamber, and a driven fan in the coolant chamber for moving cooled air therein to the inlet duct.

* * * * *